US006565353B2

(12) United States Patent
Yang

(10) Patent No.: US 6,565,353 B2
(45) Date of Patent: May 20, 2003

(54) LIGHTER WITH IMPROVED IGNITION SYSTEM

(76) Inventor: John Jiin Chung Yang, 15443 Proctor Ave., Suite B, Industry, CA (US) 91745

( * ) Notice: Subject to any disclaimer, the term of this patent is extended or adjusted under 35 U.S.C. 154(b) by 35 days.

(21) Appl. No.: 09/895,056

(22) Filed: Jun. 29, 2001

(65) Prior Publication Data

US 2003/0003412 A1 Jan. 2, 2003

(51) Int. Cl.[7] ..... F23Q 2/16; F23Q 2/46
(52) U.S. Cl. ..... 431/153; 431/277
(58) Field of Search ..... 431/153, 273–277, 431/133

(56) References Cited

U.S. PATENT DOCUMENTS

| | | | | | |
|---|---|---|---|---|---|
| 3,827,852 | A | * | 8/1974 | Chevallier | 431/254 |
| 4,099,907 | A | * | 7/1978 | Fuller | 431/254 |
| 4,595,352 | A | * | 6/1986 | Endelson | 431/253 |
| 5,020,990 | A | * | 6/1991 | Chen | 431/274 |
| 5,358,401 | A | * | 10/1994 | Iwahori et al. | 431/153 |
| 5,833,448 | A | * | 11/1998 | Doucet et al. | 431/153 |
| 5,980,239 | A | * | 11/1999 | Doucet et al. | 431/153 |
| 6,116,892 | A | * | 9/2000 | Yang | 431/153 |

FOREIGN PATENT DOCUMENTS

| | | | | |
|---|---|---|---|---|
| JP | 53-111872 | * | 9/1978 | 431/277 |
| JP | 02-259330 | * | 10/1990 | 431/277 |
| JP | 06307639 | * | 11/1994 | 431/277 |
| JP | 08-14559 | * | 1/1996 | 431/277 |

* cited by examiner

*Primary Examiner*—Carl D. Price
(74) *Attorney, Agent, or Firm*—Raymond Y. Chan; David and Raymond Patent Group

(57) ABSTRACT

An improved ignition system incorporated with a lighter includes a flint supported by a flint-spring between two supporting walls of the lighter. A striker wheel having a circumferential coarse striking surface positioned right above the flint is rotatably mounted between the two supporting walls. At least a driving wheel, having a plurality of gear teeth, is coaxially attached to a side of the striker wheel. A pusher button slidably disposed in a pusher cavity in a vertically movable manner. At least a trigger protrusion is outwardly protruded from a front wall of the pusher button wherein the trigger protrusion has at least an engaging tooth adapted for slidably engaging the gear teeth of the driving wheel to drive the striker wheel to rotate. And, a resilient element normally retaining and urging the pusher button in an upper normal position.

18 Claims, 6 Drawing Sheets

LIGHTER WITH IMPROVED IGNITION SYSTEM

BACKGROUND OF THE PRESENT INVENTION

1. Field of Invention

The present invention relates to a flint type lighter, and more particularly to a lighter incorporated with an improved ignition system for preventing under age children from the usage of the lighter. Thus, no residue of the flint will stick on an adult's thumb after the ignition of the lighter.

2. Description of Related Arts

Modem butane lighters have become very popular, especially the flint type lighters since they are economy and cheap, easy operation, and easy to fight the fire.

However, the conventional flint type lighters have drawbacks in their usage. During the ignition of the lighter, a spark wheel must be rotated in order to strike a spark when a pusher button is depressed for releasing gas. When the quality of the flint is poor, the spark generated may not strong enough for ignition. Moreover, the actions of rotating the spark wheel and depressing the pusher button are not in on continuous motion leads to different operational results depending on the users. Moreover, when the sparks wheel gives friction to the flint in order to strike a spark, the residue of the flint will remain on the spark wheel of the lighter. So, during rotating the spark wheel, the residue of the flint may stick on an adult's thumb. In worse circumstance, the user may repeat to rotate the spark wheel when failure ignition, the user's thumb may get painful and dirty as well. Although the conventional flint type lighters are cheap and in usual shape, it is desirable to improve their drawbacks for more practical use.

Nowadays, a piezoelectric lighter is getting more popular wherein the piezoelectric lighter comprises a piezoelectric unit for generating piezoelectricity. The user can merely depress the pusher button in order to ignite the lighter. However, the piezoelectric unit is widely used in a high class lighter but it is not widely used in a disposable lighter because the cost of the piezoelectric unit, especially the good quality piezoelectric unit, is too high to install in the disposable lighter. The use of the piezoelectric lighter is still restricted in certain circumstances. So, an alternative is sought for.

An improved flint type disposable lighter comprises a striker blade for substituting the conventional spark wheel to strike a spark against the flint. In order to ignite such disposable lighter, the user must apply a radial pulling force on the pusher button to pull the striker blade outwardly in such a manner that the spark will be generated through a mutual friction between the striker blade and the flint to ignite the lighter. So, in the ignition process, the user's thumb will not directly in contact with the striker blade so as to prevent the residue of the flint stunk on the user's thumb. However, the spark may not strong enough to ignite the emitting gas which leads the failure ignition of the lighter. So, the user may merely to ignite the lighter repeatedly.

Furthermore, it is now required a safety device for preventing under age children form the usage of the lighter. The present invention provides not only a safety arrangement avoiding the lighter to be ignited accidentally but also a solution to solve the drawbacks set forth above.

SUMMARY OF THE PRESENT INVENTION

A main object of the present invention is to provide a lighter incorporated with an improved ignition system wherein no residue of the flint will stick on an adult's thumb after the ignition of the lighter.

Another object of the present invention is to provide a lighter with an improved ignition system, wherein the ignition of the lighter requires a simple slide-down action to rotate the spark wheel instead of a conventional radial action. In other words, an adult's thumb can simply apply a single depressing force on the pusher button to drive the spark wheel to rotate so as to ignite the lighter.

Another object of the present invention is to provide a lighter with an improved ignition system for preventing under age children from the usage of the lighter.

Another object of the present invention is to provide a lighter with an improved ignition system wherein the gas lever is frictionally actuated by the pusher button, not by the engagement, for releasing gas so as to prevent the distortion of the gas lever.

Another object of the present invention is to provide a lighter with an improved ignition system which is adapted to be installed to all kinds of flint type lighter.

Another object of the present invention is to provide a lighter with an improved ignition system which does not require to alter the original structure design of the flint type lighter, so as to minimize the manufacturing cost of incorporating the ignition system with every conventional flint type lighter having a pusher button.

Accordingly, in order to accomplish the above objects, the present invention provides a lighter, comprising:

a supporting frame comprising a casing having a liquefied gas chamber and a pusher cavity, a pair of supporting walls protruded on opposite sides of a ceiling of the casing, a gas lever pivotally supported between the two supporting walls, a gas emitting nozzle appearing from the ceiling of the casing and communicating with the liquefied gas chamber which is actuated by the gas lever for releasing gas, a flame regulator encircling with the gas emitting nozzle to control the flow of the gas through the gas emitting nozzle, and a windshield mounted on the ceiling of the casing for encircling the gas emitting nozzle; and an ignition system, comprising:

a flint supported by a flint-spring wherein the flint and the flint-spring are received in a flint housing provided on the ceiling of the casing between the two supporting walls;

a striker wheel having a circumferential coarse striking surface positioned right above the flint being rotatably mounted between the two supporting walls by means of a wheel axle;

at least a driving wheel coaxially attached to a side of the striker wheel, wherein the driving wheel has a plurality of gear teeth spacedly provided on an outer circumferential surface thereof and a diameter larger than a diameter of the striker wheel;

a pusher button slidably disposed in the pusher cavity in a vertically movable manner;

at least a trigger protrusion outwardly protruded from a front wall of the pusher button wherein the trigger protrusion has at least an engaging tooth provided on an front end thereof and adapted for slidably engaging with the gear teeth of the driving wheel to drive the striker wheel to rotate; and a resilient element normally retaining and urging the pusher button in an upper normal position wherein the resilient element has two ends biasing against the pusher button and the ceiling of the casing.

For actuating the lighter, the pusher button has a front slanted surface provided on a bottom portion of the front wall thereof wherein the front slanted surface of the pusher button is frictionally engaged with a bent-down depressing end of the gas lever in such a manner that when the pusher button is depressed downwardly, the depressing end of the gas lever is driven downwardly, so as to pivotally lift up the gas emitting nozzle for releasing gas.

In order to ignite the lighter, the pusher button must be instantaneously depressed to frictionally drive the depressing end of the gas lever for releasing gas. Simultaneously, the engaging tooth of the trigger protrusion is slidably engaged with the gear teeth of the driving wheel so as to drive the striker wheel to rotate. So, a spark will be generated through the mutual friction between the circumferential coarse striking surface of the striker wheel and the flint. When the depressing force applied on the pusher button is released, the resilient element will push the pusher button upward to its upper normal position.

DETAILED DESCRIPTION OF THE PREFERRED EMBODIMENT

Figure 1:
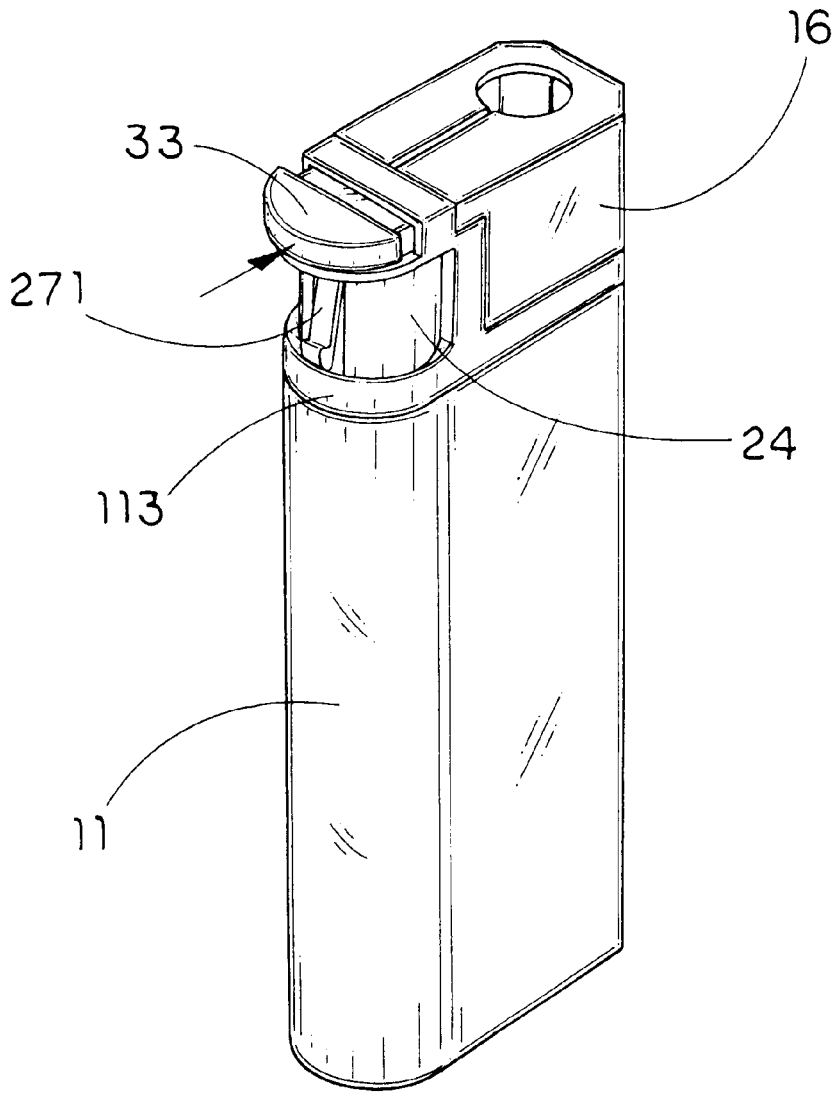
FIG. 1 is a perspective view of a lighter incorporated with an improved ignition system according to a first preferred embodiment of the present invention.
Figure 2:
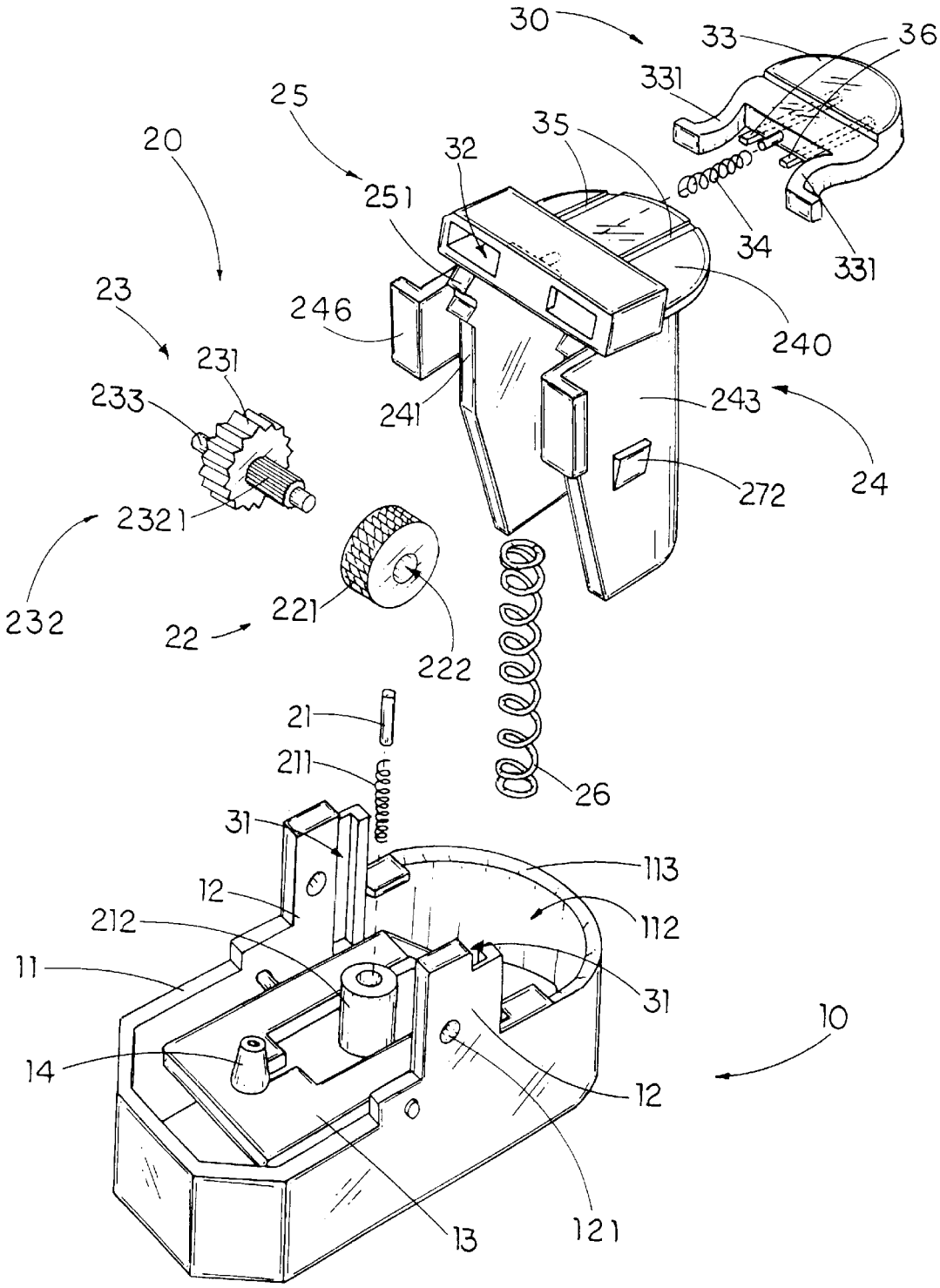
FIG. 2 is an exploded perspective view of the improved ignition system incorporating with the lighter according to the above first preferred embodiment of the present invention.

Referring to FIGS. 1 and 2 of the drawings, a lighter according to a preferred embodiment of the present invention is illustrated, wherein the lighter comprises a supporting frame 10 and an improved ignition system 20.

The supporting frame 10 comprises a casing 11 having a liquefied gas chamber 111 and a pusher cavity 112. A pair of supporting walls 12 are protruded on opposite sides of a ceiling of the casing 11. A gas lever 13 is pivotally supported between the two supporting walls 12. A gas emitting nozzle 14 is appeared from the ceiling of the casing 11 and communicating with the liquefied gas chamber 111 which is actuated by the gas lever 13 for releasing gas therefrom. A flame regulator 15 is encircling with the gas emitting nozzle 14 to control the flow of the gas through the gas emitting nozzle 14. A windshield 16 is mounted on the ceiling of the casing 11 for encircling the gas emitting nozzle 14.

The ignition system 20 of the lighter comprises a flint 21, a striker wheel 22, at least a driving wheel 23, a pusher button 24, at least a trigger protrusion 25, and a resilient element 26.

The flint 21 is supported by a flint-spring 211 wherein the flint 21 and the flint-spring 211 are received in a flint housing 212 provided on the ceiling of the casing 11 between the two supporting walls 12.

The striker wheel 22 having a circumferential coarse striking surface 221 which is in contact with the flint 21 is rotatably supported between the two supporting walls 12. The flint 21 is retained urging against the striking surface 221 of the striker wheel 22 by means of the flint-spring 211 for generating sparks directed toward the gas emitting nozzle 14 when the striking surface 221 is driven to rotatably slide against the flint 21.

According to the preferred embodiment, the driving wheel 23 is coaxially attached to one side of the striker wheel 22, wherein the driving wheel 23 has a plurality of gear teeth 231 spacedly provided on an outer circumferential surface thereof and a diameter larger than a diameter of the striker wheel 22.

The driving wheel 23 is coaxially mounted between the striker wheel 22 and the respective supporting wall 12 in a rotatably movable manner wherein the driving wheel 23 has a wheel axle 232 coaxially protruded from an inner side of the driving wheel 23 and a support shaft 233 coaxially protruded from an outer side of the driving wheel 23. The supporting shaft 233 and the wheel axle 232 are rotatably inserted into two supporting holes 121 provided on two supporting walls 12 respectively. The wheel axle 232 has a end portion for fittedly and rotatably inserted into the respective supporting hole 121 of the supporting wall 12 and a mid-portion having at least a driven tooth 2321 outwardly protruded therefrom for securely engaging with an inner circumferential surface of the axle hole 222 of the striker wheel 22. Therefore, the striker wheel 22 is capable of being driven to rotate when driving the driving wheel 23 to rotate.

The pusher button 24 is slidably disposed in the pusher cavity 112 of the casing 11 in a vertically movable manner wherein the pusher button 24 is arranged in such manner that when the pusher button 24 is depressed downwardly with respect to the casing 11, an depressible end 131 of the gas lever 13 is depressed downwardly so as to pivotally lift up the gas emitting nozzle 14 for releasing gas.

The trigger protrusion 25 is outwardly protruded from a front wall 241 of the pusher button 24 wherein the trigger protrusion 25 has at least an engaging tooth 251 provided on an front end thereof and adapted for slidably engaging with the gear teeth 231 of the driving wheel 23 to drive the striker wheel 22 to rotate when the pusher button 24 is depressed downwardly.

The trigger protrusion 25 is integrally and frontwardly extended from the front wall 241 of the pusher button 24 and arranged to align with the driving wheel 23 wherein a downward traveling distance of the trigger protrusion 25 must be at least equal to a radial traveling distance of the striker wheel 22 that enough to strike a spark against the flint 21. In other words, when the pusher button 24 is downwardly depressed from its normal upper position to its lower ignition position, the trigger protrusion 25 is adapted to radially rotate the striker wheel 22 to strike a spark against the flint 21.

The resilient element 26 is normally retaining and urging the pusher button 24 in an upper normal position wherein the resilient element 26 has two ends biasing against the pusher button 24 and the ceiling of the casing 1.

The resilient element 26, according to the preferred embodiment, is a compression spring which is disposed in the pusher cavity 112 and is provided between the pusher button 24 and a bottom surface of the pusher cavity 112. The resilient element 26 has two ends biasing against a ceiling of the pusher button 24 and the bottom surface of the pusher cavity 112. Accordingly, the resilient element 26 is adapted for applying an urging pressure against the pusher button 24 so as to normally urge and retain the pusher button 24 in the upper normal position.

The ignition system 20 further comprises a guiding means 27 for ensuring the spark being stroked between the striker wheel 22 and the flint 21 wherein the guiding means 27 comprises an elastic blocking arm 271 integrally and downwardly extended from a rear wall 242 of the pusher button 24 for normally biasing against an inclined top edge of an outer wall 113 of the casing 11.

Figure 3:
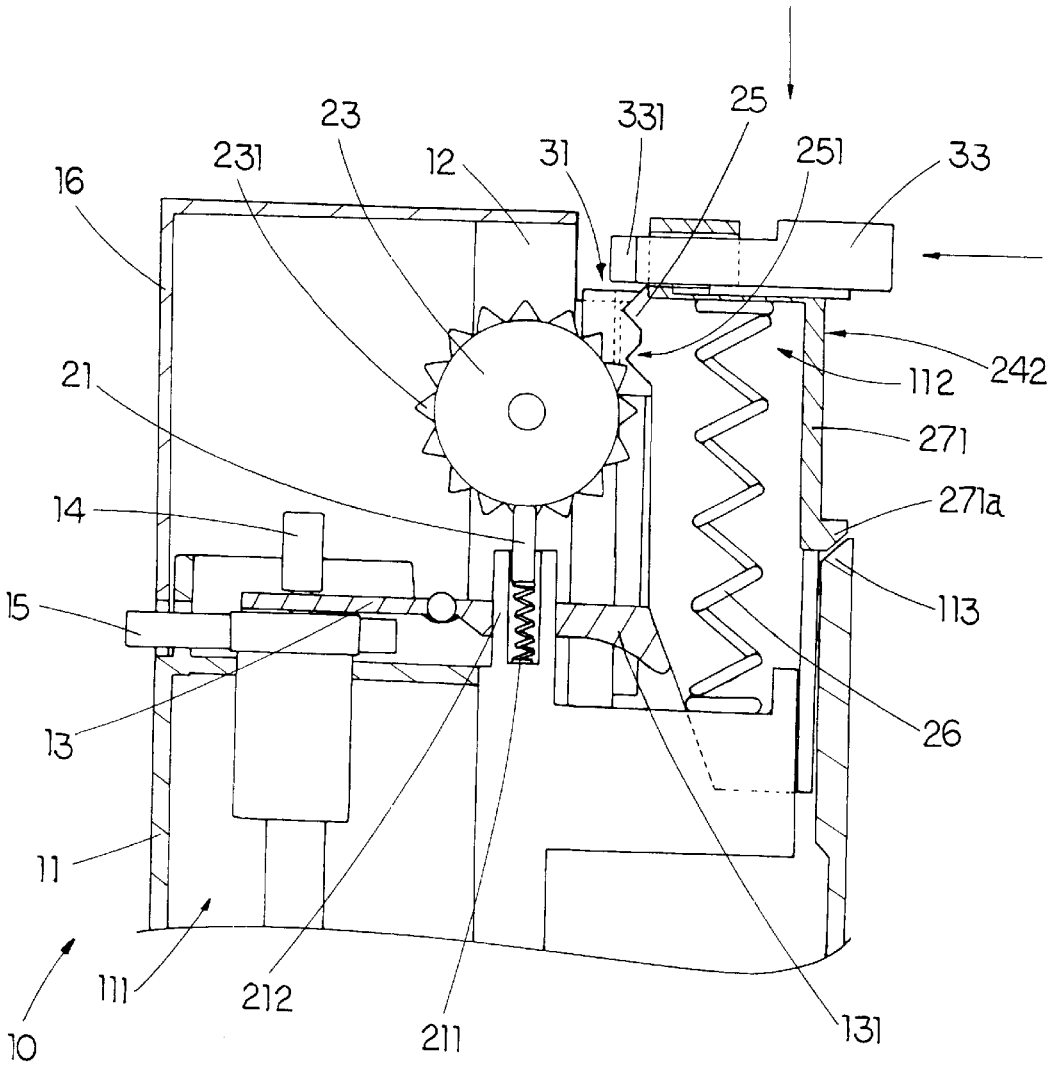
FIG. 3 is a sectional view of the improved ignition system according to the above first preferred embodiment of the present invention, illustrating the lighter in a normal position.
Figure 4:
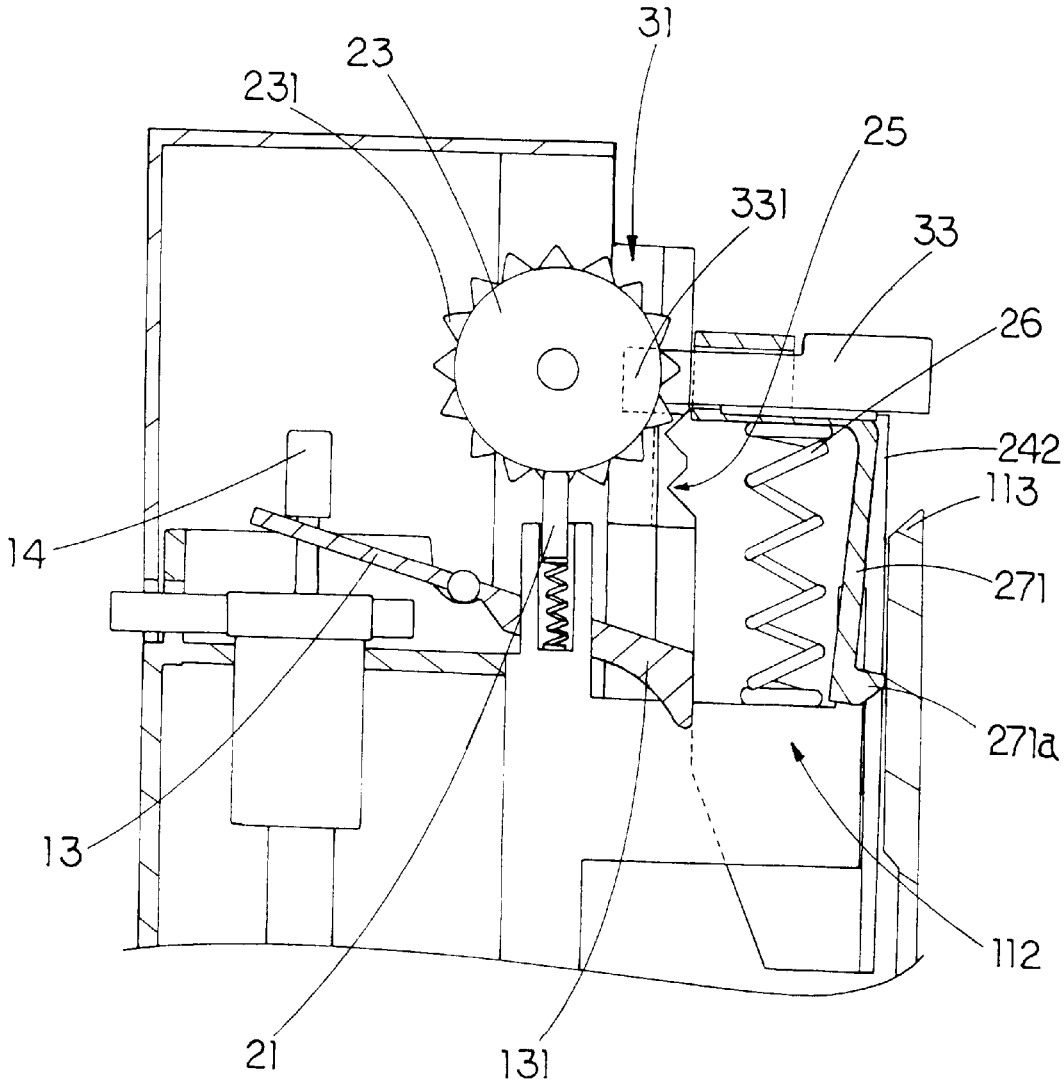
FIG. 4 is a sectional view of the improved ignition system according to the above first preferred embodiment of the present invention, illustrating the lighter in an ignition position.

As shown in FIGS. 3 and 4, the blocking arm 271 has a round bottom end 271*a* normally biased against the top edge of the rear wall 242 of the casing 11 wherein when the pusher button 24 is depressed downwardly, the bottom end 271*a* is forced to slide along the top edge of the outer wall 113 of the casing 11 and received in the pusher cavity 112. It is worth to mention that a normal rotation of the striker wheel 22 cannot strike a spark against the flint 21. In order to produce a spark, an instantaneous rotational force must be applied on the striker wheel 22 to frictionally engage with the flint 21. So, the depressing force applied on the pusher button 24 must be strong enough to push the bottom end 271*a* of the blocking arm 271 to slidably move away the top edge of the outer wall 113 of the casing 11 so as to create an instantaneous downward force to rotate the striker wheel 22. Thus, the inclined top edge of the outer wall 113 of the casing 11 will help the bottom end 271*a* of the blocking arm 271 to slide downwardly into the pusher cavity 112. When the depressing force applied on the pusher button 24 is released, the pusher button 24 is pushed upwardly and return to its upper normal position, the bottom end 271*a* of the blocking arm 271 will be rebounded to its original form to slidably bias against the top edge of the outer wall 113 of the casing 11.

The guiding means 27 further comprises a pair of blocking latches 272 outwardly protruded from two sidewalls 243 of the pusher button 24 for biasing against two L-shaped top edges of two sidewalls of the pusher cavity 112 respectively, so as to retain the pusher button 24 in the normal upper position and prevent the pusher button 24 being slid out of the pusher cavity 112.

The lighter of the present invention further comprises a safety device 30 for preventing the lighter from being ignited accidentally and intentionally. The safety device 30 has a pair of sliding grooves 31 vertically formed on two inner sides of the supporting walls 12 respectively and a slider cavity 32 transversely formed on a top portion of the pusher button 24.

The safety device 30 further comprises a locking member 33 slidably mounted on a top ceiling 240 of the pusher button 24 comprising a pair of L-shaped locking arms 331 slidably penetrated through the slider cavity 32 and arranged to be driven to move from a normal locking position to an unlocked position, and an elastic element 34 for applying an urging pressure against the locking member 33 so as to normally retain the locking member 33 at the normal locking position. In which, in the locking position, the locking arms 331 of the locking member 33 are biased against two top edges of the supporting walls 12 respectively for blocking up the pusher button 24 from being slid downwardly. In the unlocked position, the locking member 33 is pushed inwardly to move the two free ends of the locking arms 331 aligning with the sliding grooves 31, such that the pusher button 24 is capable of being slid downwardly while the two ends of the locking arms 331 are sliding on the sliding grooves 31, so as to ignite the lighter, as shown in FIG. 4.

As shown in FIG. 2, the safety device 30 further has a pair of parallel guiding tracks 35 provided on the top ceiling 240 of the pusher button 24 and a pair of corresponding projections 36 downwardly formed on the locking member 33 and arranged to slidably mounted on the guiding tracks 35 respectively, so as to ensure a sliding movement of the pusher button 24 on the pusher button 24.

Accordingly, the elastic element 34, which is a compression spring disposed in the slider cavity 32 has two ends for biasing against the locking member 33 and the pusher button 24 respectively, so as to urge and retain the locking member 33 in the normal unlocked position.

The pusher button 24 further comprises two opposed L-shaped guiding arms 246 integrally extended from the front wall 241 of the pusher button 24 wherein two free ends of the guiding arms 246 are slidably mounted on the two sliding grooves 31 on the supporting walls 12 respectively, so as to ensure a vertical movement of the pusher button 24 within the pusher cavity 112.

As shown in FIG. 3, the gas lever 13 has a downwardly bent depressible end 131 arranged to be driven downwardly to pivotally lift up the gas emitting nozzle 14. The pusher button 24 has a front slanted surface 245 provided on a bottom portion of the front wall 241 thereof wherein the front slanted surface 245 of the pusher button 24 is frictionally engaged with the depressing end 131 of the gas lever 13 in such a manner that when the pusher button 24 is depressed downwardly, the depressing end 131 of the gas lever 13 is driven downwardly, so as to pivotally lift up the gas emitting nozzle 14 for releasing gas.

The pivotal actuating motion of the gas lever 13 is shorter than the radial rotating motion of the striker wheel 22 wherein these two motions are operated by a slide down motion of the pusher button 24. So, the downward movement of the pusher button 24 for frictionally sliding on the depressible end 131 of the gas lever 13 can be self-adjusted to fit the motion to radially rotate the striker wheel 22, so as to prevent the distortion of the gas lever 13 over a period of continued use of the lighter. It is worth to mention that such actuation arrangement can incorporate with a conventional piezoelectric lighter that requires a slide down motion of the pusher button to depress the piezoelectric unit and the gas lever at the same time to ignite the lighter.

In order to ignite the lighter of the present invention, an inward force must be applied on the locking member 33 until the two locking arms 331 are aligned right above the two sliding grooves 31 respectively, so as to unlock the lighter. Then, an instantaneous depressing force must be applied on the pusher button 24 for pushing the bottom end of the blocking arm 271 to move away from the top edge of the casing 11, and thus the gas lever 13 is frictionally driven by the pusher button 24 downwardly for releasing gas. Simultaneously, the engaging tooth 251 of the trigger protrusion 25 is slidably engaged with the gear teeth 231 of the driving wheel 23 respectively so as to drive the striker wheel 22 to rotate. So, a spark will be generated through the mutual friction between the circumferential coarse striking surface 221 of the striker wheel 22 and the flint 21. When the depressing force applied on the pusher button 24 is released, the resilient element 26 will push the pusher button 24 upward to its upper normal position.

Figure 5:
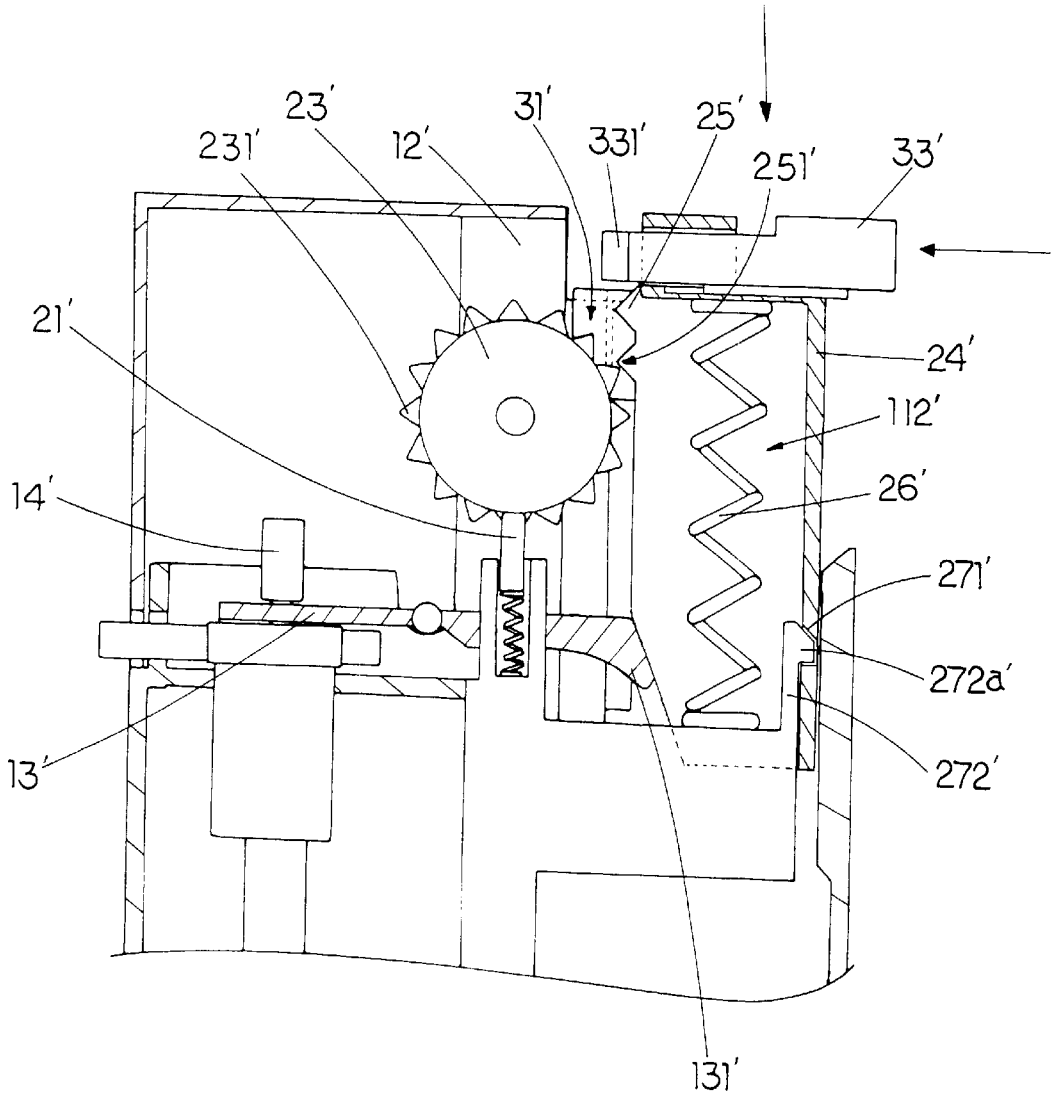
FIG. 5 is a sectional view of an ignition system incorporated with a lighter according to a second preferred embodiment of the present invention, illustrating the lighter in a normal position.
Figure 6:
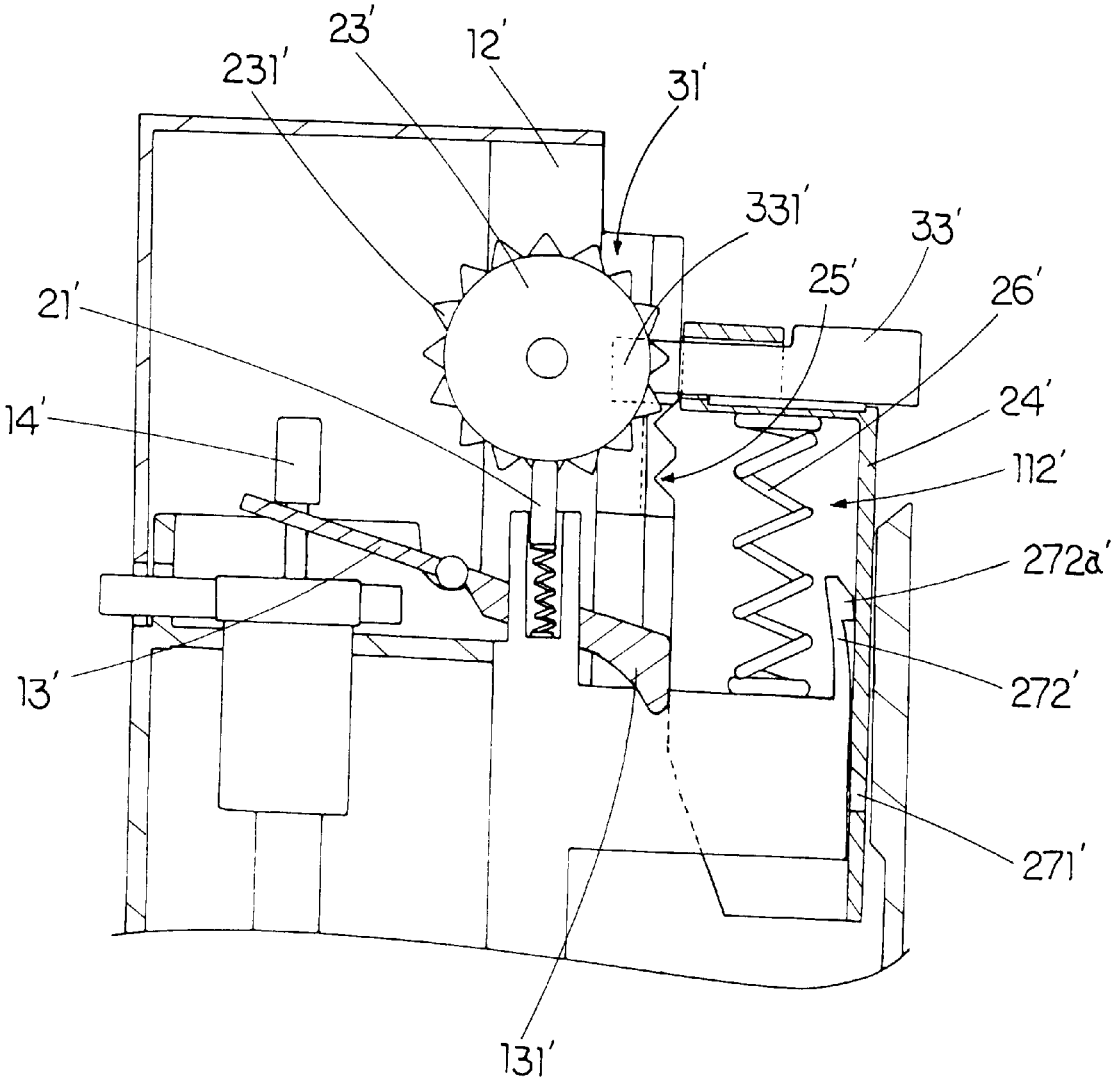
FIG. 6 is a sectional view of the ignition system incorporated with the lighter according to the above second preferred embodiment of the present invention, illustrating the lighter in an ignition position.

Referring to FIGS. 5 and 6, a second embodiment of the lighter illustrates an alternative mode of the first embodiment of the present invention, wherein the guiding means 27' has a guiding slot 271' formed on an inner wall of the pusher button 24' and an elastic blocking arm 272', having a top blocking tip 272*a'*, upwardly extended from the pusher cavity 112' wherein the blocking tip 272*a'* is normally engaged with the guiding slot 271' so as to lock up the pusher button 24' in the upper normal position. So, the downward force is applied on the pusher button 24' must be strong enough to slidably move the blocking tip 272*a'* of the blocking arm 272' away from the guiding slot 271', so as to create the instantaneous downward force to rotate the striker wheel 22'. When the downward force applied on the pusher button 24' is released, the pusher button 24' is pushed upwardly to its upper normal position. The blocking tip 272*a'* of the locking arm 272' will slide along the inner wall of the pusher button 24' and re-engage with the guiding slot 271'. Preferably, the blocking tip 272*a'* of the locking arm 272' has a top inclined surface that helps the blocking tip 272*a'* slidably move away from the guiding slot 271' when the pusher button 24' is depressed downwardly.

What is claimed is:

1. A lighter, comprising:

a supporting frame comprising:

a casing having a liquefied gas chamber and a pusher cavity, a pair of supporting walls protruded on opposite sides of a ceiling of said casing, a flint housing provided on said ceiling of said casing between said two supporting walls, a gas lever pivotally supported between said two supporting walls, and a gas emitting nozzle appearing from said ceiling of said casing and communicating with said liquefied gas chamber which is actuated by said gas lever for releasing gas;

an ignition system, comprising:

a flint supported by a flint-spring wherein said flint and said flint-spring are received in said flint housing, a striker wheel having a circumferential coarse striking surface and being positioned right above said flint and rotatably supported between said two supporting walls, at least a driving wheel coaxially attached to a side of said striker wheel, wherein said driving wheel has a plurality of gear teeth spacedly provided on an outer circumferential surface thereof and a diameter larger than a diameter of the striker wheel, a pusher button slidably disposed in said pusher cavity in a vertically movable manner, at least a trigger protrusion outwardly protruded from a front wall of said pusher button, wherein said trigger protrusion has at least an engaging tooth provided on an front end thereof and adapted for slidably engaging said the gear teeth of said driving wheel to drive said striker wheel to rotate, and a resilient element normally retaining and urging said pusher button in an upper normal position wherein said resilient element has two ends biasing against said pusher button and said ceiling of said casing; and a guiding means, which is adapted for ensuring said spark stroked between said striker wheel and said flint, comprising an elastic blocking arm integrally and downwardly extended from a rear wall of said pusher button for normally biasing against a top edge of an outer wall of said casing, wherein said blocking arm is adapted for slidably moving away from said top edge of said outer wall of said casing when said pusher button is depressed downward, so as to create an instantaneous motion of said striker wheel.

2. A lighter, as recited in claim 1, wherein said blocking arm has a round bottom end normally biases against said top inclined edge of said outer wall of said casing in such a manner that said bottom end of said blocking arm is arranged to slide along said top edge of said casing into said pusher cavity when depressing said pusher and slidably bias against said top edge of said casing when said pusher button is pushed upwardly to said upper normal position.

3. A lighter, as recited in claim 2, wherein said guiding means further comprises a pair of blocking latches outwardly protruded from two sidewalls of said pusher button for biasing against two L-shaped top edges of two sidewalls of said pusher cavity respectively, so as to retain said pusher button in said normal upper position and prevent said pusher button being slid out of said pusher cavity.

4. A lighter, as recited in claim 2, further comprising a safety device having a pair of sliding grooves vertically formed on two inner sides of said supporting walls respectively and a slider cavity transversely formed on a top portion of said pusher button, said safety device further comprising a locking member slidably mounted on a top ceiling of said pusher button comprising a pair of L-shaped locking arms slidably penetrated through said slider cavity and arranged to be driven to move from a normal locking position to an unlocked position, and an elastic element for applying an urging pressure against said locking member so as to normally retain said locking member at said normal locking position, wherein in said locking position, said locking arms of said locking member are biased against two top edges of said supporting walls for blocking up said pusher button from being slid downwardly, and in the unlocked position, said locking member is pushed inwardly to move the two free ends of said locking arms aligning right above said two sliding grooves respectively, such that said pusher button is capable of being slid downwardly while said two ends of the locking arms are sliding on said sliding grooves, so as to ignite said lighter.

5. A lighter, as recited in claim 4, wherein said safety device further has a pair of parallel guiding tracks provided on said top ceiling of said pusher button and a pair of corresponding projections downwardly formed on said locking member and arranged to slidably mounted on said guiding tracks respectively, so as to ensure a sliding movement of said pusher button on said pusher button.

6. A lighter, as recited in claim 2, wherein said gas lever has a downwardly bent depressible end arranged to be driven downwardly to pivotally lift up said gas emitting nozzle and wherein said pusher button has a front slanted surface provided on a bottom portion of said front wall thereof wherein said front slanted surface of said pusher button is frictionally engaged with said depressing end of said gas lever in such a manner that when said pusher button is depressed downwardly, said depressing end of said gas lever is driven downwardly, so as to pivotally lift up said gas emitting nozzle for releasing gas.

7. A lighter, as recited in claim 5, wherein said gas lever has a downwardly bent depressible end arranged to be driven downwardly to pivotally lift up said gas emitting nozzle and wherein said pusher button has a front slanted surface provided on a bottom portion of said front wall thereof wherein said front slanted surface of said pusher button is frictionally engaged with said depressing end of said gas lever in such a manner that when said pusher button is depressed downwardly, said depressing end of said gas lever is driven downwardly, so as to pivotally lift up said gas emitting nozzle for releasing gas.

8. A lighter, comprising:

a supporting frame comprising:

a casing having a liquefied gas chamber and a pusher cavity, a pair of supporting walls protruded on opposite sides of a ceiling of said casing, a flint housing provided on said ceiling of said casing between said two supporting walls, a gas lever pivotally supported between said two supporting walls, and a gas emitting nozzle appearing from said ceiling of said casing and communicating with said liquefied gas chamber which is actuated by said gas lever for releasing gas;

an ignition system, comprising:

a flint supported by a flint-spring wherein said flint and said flint-spring are received in said flint housing, a striker wheel having a circumferential coarse striking surface and being positioned right above said flint and rotatably supported between said two supporting walls, at least a driving wheel coaxially attached to a side of said striker wheel, wherein said driving wheel has a plurality of gear teeth spacedly provided on an outer circumferential surface thereof and a diameter larger than a diameter of the striker wheel, a pusher button slidably disposed in said pusher cavity in a vertically movable manner, at least a trigger protrusion outwardly protruded from a front wall of said pusher button, wherein said trigger protrusion has at least an engaging tooth provided on an front end thereof and adapted for slidably engaging said the gear teeth of said driving wheel to drive said striker wheel to rotate, and a resilient element normally retaining and urging said pusher button in an upper normal position wherein said resilient element has two ends biasing against said pusher button and said ceiling of said casing; and a safety device having a pair of sliding grooves vertically formed on two inner sides of said supporting walls respectively and a slider cavity transversely formed on a top portion of said pusher button, said safety device further comprising a locking member slidably mounted on a top ceiling of said pusher button comprising a pair of L-shaped locking arms slidably penetrated through said slider cavity and arranged to be driven to move from a normal locking position to an unlocked position, and an elastic element for applying an urging pressure against said locking member so as to normally retain said locking member at said normal locking position, wherein in said locking position, said locking arms of said locking member are biased against two top edges of said supporting walls for blocking up said pusher button from being slid downwardly, and in the unlocked position, said locking member is pushed inwardly to move the two free ends of said locking arms aligning right above said two sliding grooves respectively, such that said pusher button is capable of being slid downwardly while said two ends of the locking arms are sliding on said sliding grooves, so as to ignite said lighter.

9. A lighter, as recited in claim 8, wherein said safety device further has a pair of parallel guiding tracks provided on said top ceiling of said pusher button and a pair of corresponding projections downwardly formed on said locking member and arranged to slidably mounted on said guiding tracks respectively, so as to ensure a sliding movement of said pusher button on said pusher button.

10. A lighter, comprising:

a supporting frame comprising:

a casing having a liquefied gas chamber and a pusher cavity, a pair of supporting walls protruded on opposite sides of a ceiling of said casing, a flint housing provided on said ceiling of said casing between said two supporting walls, a gas lever pivotally supported between said two supporting walls, and a gas emitting nozzle appearing from said ceiling of said casing and communicating with said liquefied gas chamber which is actuated by said gas lever for releasing gas;

an ignition system, comprising:

a flint supported by a flint-spring wherein said flint and said flint-spring are received in said flint housing, a striker wheel having a circumferential coarse striking surface and being positioned right above said flint and rotatably supported between said two supporting walls, at least a driving wheel coaxially attached to a side of said striker wheel, wherein said driving wheel has a plurality of gear teeth spacedly provided on an outer circumferential surface thereof and a diameter larger than a diameter of the striker wheel, a pusher button slidably disposed in said pusher cavity in a vertically movable manner, at least a trigger protrusion outwardly protruded from a front wall of said pusher button, wherein said trigger protrusion has at least an engaging tooth provided on an front end thereof and adapted for slidably engaging said the gear teeth of said driving wheel to drive said striker wheel to rotate, and a resilient element normally retaining and urging said pusher button in an upper normal position wherein said resilient element has two ends biasing against said pusher button and said ceiling of said casing; and a guiding means for ensuring said spark stroked between said striker wheel and said flint wherein said guiding means has a guiding slot formed on an inner wall of said pusher button and an elastic blocking arm, having a top blocking tip, upwardly extended from said pusher cavity wherein said blocking tip is normally engaged with said guiding slot so as to lock up said pusher button in said upper normal position and adapted for slidably moving away from said guiding slot when said pusher button is depressed downwardly.

11. A lighter, as recited in claim 10, wherein said blocking tip of said locking arm has a top inclined surface that helps said blocking tip slidably moved away from said guiding slot when said pusher button is depressed downwardly.

12. A lighter, as recited in claim 10, further comprising a safety device having a pair of sliding grooves vertically formed on two inner sides of said supporting walls respectively and a slider cavity transversely formed on a top portion of said pusher button, said safety device further comprising a locking member slidably mounted on a top ceiling of said pusher button comprising a pair of L-shaped locking arms slidably penetrated through said slider cavity and arranged to be driven to move from a normal locking position to an unlocked position, and an elastic element for applying an urging pressure against said locking member so as to normally retain said locking member at said normal locking position, wherein in said locking position, said locking arms of said locking member are biased against two top edges of said supporting walls for blocking up said pusher button from being slid downwardly, and in the unlocked position, said locking member is pushed inwardly to move the two free ends of said locking arms aligning right above said two sliding grooves respectively, such that said pusher button is capable of being slid downwardly while said two ends of the locking arms are sliding on said sliding grooves, so as to ignite said lighter.

13. A lighter, as recited in claim 12, wherein said safety device further has a pair of parallel guiding tracks provided on said top ceiling of said pusher button and a pair of corresponding projections downwardly formed on said locking member and arranged to slidably mounted on said guiding tracks respectively, so as to ensure a sliding movement of said pusher button on said pusher button.

14. A lighter, as recited in claim 13, wherein said gas lever has a downwardly bent depressible end arranged to be driven downwardly to pivotally lift up said gas emitting nozzle and wherein said pusher button has a front slanted surface provided on a bottom portion of said front wall thereof wherein said front slanted surface of said pusher button is frictionally engaged with said depressing end of said gas lever in such a manner that when said pusher button is depressed downwardly, said depressing end of said gas lever is driven downwardly, so as to pivotally lift up said gas emitting nozzle for releasing gas.

15. A lighter, comprising:

a supporting frame comprising a casing having a liquefied gas chamber and a pusher cavity, a pair of supporting walls protruded on opposite sides of a ceiling of said casing, a gas lever, having a downwardly bent depressible end, pivotally supported between said two supporting walls, a gas emitting nozzle appearing from said ceiling of said casing and communicating with said liquefied gas chamber which is actuated by said gas lever for releasing gas; and an ignition system comprising:

a pusher button slidably disposed in said pusher cavity in a vertically movable manner for igniting said lighter, wherein said pusher button has a front slanted surface provided on a bottom portion of said front wall thereof, wherein said front slanted surface of said pusher button is frictionally engaged with said depressing end of said gas lever in such a manner that when said pusher button is depressed downwardly, said depressing end of said gas lever is driven downwardly, so as to pivotally lift up said gas emitting nozzle for releasing gas; and a flint supported by a flint-spring, wherein said flint and said flint-spring are received in a flint housing provided on said ceiling of said casing between said two supporting walls, a striker wheel having a circumferential coarse striking surface positioned right above said flint being rotatably supported between said two supporting walls, and a resilient element normally retaining and urging said pusher button in an upper normal position wherein said resilient element has two ends biasing against said pusher button and said ceiling of said casing.

16. A lighter, as recited in claim 15, wherein said ignition system further comprises at least a driving wheel coaxially attached to a side of said striker wheel, wherein said driving wheel has a plurality of gear teeth spacedly provided on an outer circumferential surface thereof and a diameter larger than a diameter of the striker wheel, and at least a trigger protrusion outwardly protruded from a front wall of said pusher button wherein said trigger protrusion has at least an engaging tooth provided on an front end thereof and adapted for slidably engaging said the gear teeth of said driving wheel to drive said striker wheel to rotate.

17. A lighter, as recited in claim 16, further comprising a safety device having a pair of sliding grooves vertically formed on two inner sides of said supporting walls respectively and a slider cavity transversely formed on a top portion of said pusher button, said safety device further comprising a locking member slidably mounted on a top ceiling of said pusher button comprising a pair of L-shaped locking arms slidably penetrated through said slider cavity and arranged to be driven to move from a normal locking position to an unlocked position, and an elastic element for applying an urging pressure against said locking member so as to normally retain said locking member at said normal locking position, wherein in said locking position, said locking arms of said locking member are biased against two top edges of said supporting walls for blocking up said pusher button from being slid downwardly, and in the unlocked position, said locking member is pushed inwardly to move the two free ends of said locking arms aligning right above said two sliding grooves respectively, such that said pusher button is capable of being slid downwardly while said two ends of the locking arms are sliding on said sliding grooves, so as to ignite said lighter.

18. A lighter, as recited in claim 17, further comprising a guiding means for ensuring said spark stroked between said striker wheel and said flint wherein said guiding means comprises an elastic blocking arm integrally and downwardly extended from a rear wall of said pusher button for normally biasing against a top edge of an outer wall of said casing wherein said blocking arm is adapted for slidably moving away from said top edge of said outer wall of said casing when said pusher button is depressed downward, so as to create an instantaneous motion of said striker wheel.

* * * * *